US008920022B2

(12) United States Patent
Ishida et al.

(10) Patent No.: US 8,920,022 B2
(45) Date of Patent: Dec. 30, 2014

(54) WATERPROOF DEVICE AND PORTABLE TIMEPIECE

(71) Applicant: Seiko Instruments Inc., Chiba-shi, Chiba (JP)

(72) Inventors: Masahiro Ishida, Chiba (JP); Masataka Hayashi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 14/182,134

(22) Filed: Feb. 17, 2014

(65) Prior Publication Data

US 2014/0233359 A1 Aug. 21, 2014

(30) Foreign Application Priority Data

Feb. 19, 2013 (JP) ..... 2013-030304

(51) Int. Cl.
*G04B 37/10* (2006.01)
*H01H 13/06* (2006.01)

(52) U.S. Cl.
CPC ..... *G04B 37/106* (2013.01); *H01H 13/06* (2013.01)
USPC ..... 368/290; 368/320

(58) Field of Classification Search
CPC ..... G04B 3/048; G04B 37/106; H01H 13/06
USPC ..... 368/288–290, 319–321; 200/302.1, 200/302.2, 341, 345, 520, 537
See application file for complete search history.

(56) References Cited

U.S. PATENT DOCUMENTS 2,237,860 A * 4/1941 Bolle ..... 368/289
2,497,935 A * 2/1950 Feurer ..... 368/288
3,621,649 A * 11/1971 Vulcan et al. ..... 368/290
6,872,899 B2 3/2005 Oshio et al.

FOREIGN PATENT DOCUMENTS

JP 2004-319446 A 11/2004
JP 2011-258334 A 12/2011

* cited by examiner

*Primary Examiner* — Vit W Miska
(74) *Attorney, Agent, or Firm* — Brinks Gilson & Lione

(57) ABSTRACT

Provision of a waterproof device capable of improving waterproof property in a push-in operation portion formed by including an extensible member, a holding member and an operation shaft. A wrist watch (portable device) 11 includes an outer case (device outer housing) 12, an extensible member 32 with waterproof property, a holding member 41 attached to the case 12 and an operation shaft 51. The case 12 includes a seating portion 29 and a hole 30. The extensible member 32 includes a cylindrical portion 33 which can be extended/retracted in an axial direction, closing one end as well as opening the other end, and inserted into the hole 30, and a flange 35 projecting integrally from an outer periphery of the other end portion of the cylindrical portion and seated on the seating portion 29. The holding member 41 includes a presser portion 42 sandwiching the flange 35 with the seating portion 29 to thereby secure the waterproofing around the flange, and a through hole 44 connecting to the opening of the cylindrical portion 33. The operation shaft 51 includes a shaft end portion 52 protruding to the outside of the holding member 41 through the through hole 44. The operation shaft 51 is inserted into the cylindrical portion 33 and arranged in a state of being able to be pushed from the outside of the case 12 so as to allow the cylindrical portion 33 to extend.

15 Claims, 7 Drawing Sheets

WATERPROOF DEVICE AND PORTABLE TIMEPIECE

RELATED APPLICATIONS

This application claims priority under 35 U.S.C. §119 to Japanese Patent Application No. 2013-030304 filed on Feb. 19, 2013, the entire content of which is hereby incorporated by reference.

BACKGROUND OF THE INVENTION

1. Field of the Invention

The present invention relates to a waterproof device and a portable timepiece including a push-in operation portion waterproof property of which is improved.

2. Description of the Related Art

In portable devices including portable timepieces such as a wrist watch and a pocket watch, a stopwatch, a cellular phone and a portable information terminal device, there are devices, for example, including an operation member such as a push button for operating contacts in a device outer housing, which is attached to the device outer housing. In such device, given functions are executed when the push button is pushed given times of strokes. For example, in the portable timepiece, a dial window can be illuminated, a timepiece display can be switched from an analog display to a digital display or can be inversely switched and further, the date or the day of the week which is digitally displayed can be modified.

As a shaft portion of the push button pierces the device outer housing from inside to outside in such kind of portable device, it is necessary to waterproof a portion at which the push button is formed (push-in operation portion).

In order to realize the above, a structure of waterproofing between the shaft portion of the push button and the device outer housing by fitting a seal material which has a ring shape and can be elastically deformed to the outer periphery of the shaft portion of the push button piercing a pipe fixed to the device outer housing, and allowing the seal material to be closely contacted with an inner surface of the pipe in a state where the seal material is compressed in a radial direction (refer to JP-A-2004-319446 (Patent Literature 1)).

There is also provided a method of attaching a waterproof switch member for pressing a switch inside a device casing to the casing as well as combining a push button with the waterproof switch member to thereby perform the waterproofing (for example, refer to JP-A-2011-258334 (Patent Literature 2)).

Specifically, the waterproof switch member is made of an elastic material, having an opening and a container part protruding on the opposite side of the opening. The switch member is attached to the casing in a state where the container part is inserted into a through hole formed in the casing so as to face the switch, in which the push button is arranged in a state where a shaft is inserted into an inside space of the container part so that the shaft pushes a bottom portion of the container part. Accordingly, the waterproofing from the inside space of the container part to the outside is realized by the container part. Moreover, the container part has a loop-shaped rib formed continuously formed along the outer periphery thereof. The rib is provided in a deformed state by receiving compression from an inner wall of the through hole. Accordingly, the waterproofing between the inner wall of the through hole and an outer peripheral surface of the container part is realized. When the push button is pushed, the bottom potion and a side portion of the container part extend toward the switch to thereby press the switch.

In the waterproof structure described in Patent Literature 1, when the push button is moved in an axial direction, the seal material slides along an inner surface of the pipe. Accordingly, for example, under a condition in which the portable device is exposed to water, for example, in the case where the push button is operated in water, the sealing performance becomes unstable because the portion sealed by the seal material is moved with the push button. Accordingly, there is a danger that the waterproof performance is reduced at a portion where the push button is arranged.

Also in the waterproof structure described in Patent Literature 2, there is a similar concern about waterproof property. That is, when the push button is pushed, the rib formed along the outer periphery of the side portion slides along the inner wall of the through hole as the side portion of the container part extends toward the switch. Accordingly, for example, when the push-in operation of the push button is performed in water and the like, seal performance for the waterproofing becomes unstable as the rip is moved with the push button. Accordingly, there is a danger that the waterproof performance is reduced at a portion where the push button is arranged.

The related art techniques have problems that there is room for improvement on the waterproof property around the push button.

SUMMARY OF THE INVENTION

An object of the present invention is to provide a waterproof device and a portable timepiece capable of improving waterproof property in a push-in operation portion formed by including an extensible member, a holding member and an operation shaft.

In order to solve the above problems, a waterproof device according to an embodiment of the present invention includes a device outer housing including a seating portion and a hole piercing the center of the seating portion, an extensible member with waterproof property, including a cylindrical portion which can be extended/retracted in an axial direction, closing one end in the axial direction as well as opening the other end in the axial direction, and inserted into the hole, and a flange projecting integrally from an outer periphery of the other end portion of the cylindrical portion and seated on the seating portion from the outside of the device outer housing, a holding member attached to the device outer housing, and including a presser portion sandwiching the flange with the seating portion in a thickness direction of the flange to thereby secure the waterproofing around the flange, and a through hole connecting to the opening, and an operation shaft including a shaft end portion protruding to the outside of the holding member through the through hole, which is inserted into the cylindrical portion and arranged in a state of being able to be pushed from the outside of the device outer housing so as to allow the cylindrical portion to extend.

The waterproof device according to the present invention can be applied to portable timepieces such as a wrist watch and a pocket watch, a stopwatch, a cellular phone, a portable information terminal device, a waterproof radio, a waterproof electric shaver and the like, and the device outer housing indicates an outer case and so on.

The extensible member in the present invention is integrally formed by using metal, soft plastic, synthetic rubber and so on, in which at least the cylindrical portion can be preferably deformed in an elastic manner. In this case, the closed end included in the cylindrical portion of the extensible member in the present invention is preferably formed to be relatively thick so as not to be elastically deformed easily.

Accordingly, durability of the end is improved as well as a push-in force of the operation shaft for turning on/off a switch provided inside the device outer housing for controlling the device housed in the device outer housing can be positively given to the switch.

In the present invention, it is preferable that the holding member is attached to the device outer housing by inserting a part thereof into a housing concave portion formed on the device outer housing, however, it is also preferable that the holding member is attached so as to overlap an outer surface of the device outer housing in a form in which the housing concave portion is omitted. Additionally, as a means for attaching the holding member to the device outer housing, it is preferable to screw the holding member into the device outer housing to perform attachment in a point that a fixing part is not necessary. It is also preferable, instead of the above, to attach the holding member to the device outer housing by using an attachment part such as a screw. In the present invention, it is preferable that a sealing ring which can be elastically deformed is realized by being sandwiched between the holding member and the device outer housing on preventing water from entering between the holding member and the device outer housing, however, the sealing ring can be omitted.

In the present invention, it is no problem whether the operation shaft is connected to the closed end of the cylindrical portion or not. In the structure in which the operation shaft is connected to the closed end of the cylindrical surface, it is possible to omit a device for preventing the operation shaft from falling off to the outside of the device outer housing. Conversely, when applying the structure in which the operation shaft is not connected to the closed end of the cylindrical portion, a device for preventing the operation shaft from falling off to the outside of the device outer housing may be additionally performed. In the present invention, it is also preferable to connect an operation head having a larger diameter than a shaft end portion to the shaft end portion of the operation shaft protruding to the outside of the device outer housing for facilitating the push-in operation of the operation shaft and for decoration, or the invention can be realized without connecting the above operation head. The present invention can be realized by adding a biasing member such as a spring for returning the operation shaft to a state before being pushed (unpushed state).

In the present invention, when the push-in operation is performed to the operation shaft, the operation shaft pushes and moves the closed end of the cylindrical portion included in the extensible member so as to further protrude to the inside of the device outer housing, therefore, the cylindrical portion is stretched with elastic deformation from the flange as a starting point. As the switch and so on for controlling the device housed in the device outer housing are pressed by the operation shaft through the closed end of the cylindrical portion based on the above behavior of the extensible member, a given function included in the device can be fulfilled.

As the through hole of the holding member into which the shaft end portion of the operation shaft is inserted is connected to the inside of the extensible member, the holding member and the inside of the extensible member are exposed to water when the waterproof device is used in water. As a route of water entry into device outer housing, it is possible to consider a route of passing between the flange of the extensible member and the presser portion of the holding member, then, passing between the flange and the seating portion of the device outer housing, further passing through the hole of the device outer housing.

However, as the flange of the extensible member is sandwiched between the seating portion of the device outer housing and the presser portion of the holding member in the thickness direction of the flange, the diameter of the water entry route is blocked and the waterproofing around the flange is secured. Accordingly, it is possible to prevent water from entering the inside of the device outer housing. The structure for the waterproofing is not moved in both cases where the cylindrical portion of the extensible member extends and retracts to the original state, therefore, the waterproof performance does not become unstable.

Accordingly, the waterproof property in the push-in operation portion formed by including the extensible member, the holding member and the operation shaft can be improved according to the present invention.

In the waterproof device in a preferable mode of the present invention, the holding member can be removed from the device outer housing.

In the preferable mode, the operation shaft and the extensible member can be removed by removing the holding member from the device outer housing. In other words, the push-in operation portion formed by including the extensible member, the holding member and the operation shaft can be taken apart. Accordingly, if waterproof property of the extensible member is reduced, the replacement can be performed.

In the waterproof device in a preferable mode of the present invention, the extensible member may be made of a metal bellows which is integrally formed, the presser portion may have a sealing ring which can be elastically deformed, and the sealing ring and the seating portion may sandwich the flange to thereby waterproof around the flange.

In the preferable mode, the sealing ring included in the presser portion is held in a state of being elastically deformed and closely contacting the flange of the extensible member made of the metal bellows, therefore, the water entry route from the holding member and the inside of the extensible member into the device outer housing is blocked to thereby secure the waterproofing around the flange when the waterproof device is used in water. As the structure for the waterproofing is not moved regardless of extension/retraction of the cylindrical portion of the extensible member, waterproof performance does not become unstable.

In the waterproof device in a preferable mode of the present invention, the device outer housing may have a housing concave portion into which the presser portion is inserted and including the seating portion as the bottom, and an outer periphery of the sealing ring may closely contact an inner peripheral wall surface sectioning the housing concave portion.

In the preferable mode, as the presser portion of the holding member is inserted into the housing concave portion of the device outer housing, the protrusion of the holding member from the outer surface of the device outer housing can be further reduced. Moreover, when water enters between the presser portion and the inner peripheral wall surface sectioning the housing concave portion, it is possible to block the water from reaching the inside of the device outer housing by the sealing ring closely contacting the inner peripheral wall surface sectioning the housing concave portion.

In the waterproof device in a preferable mode of the present invention, the extensible member may be made of a metal bellows which is integrally formed, the seating portion may have a sealing ring which can be elastically deformed, and the sealing ring and the presser portion may sandwich the flange to thereby waterproof around the flange.

In the preferable mode, the sealing ring included in the seating portion is held in a state of being elastically deformed and closely contacting the flange of the extensible member made of the metal bellows. Accordingly, the water entry route from the holding member and the inside of the extensible member into the device outer housing is blocked to thereby secure the waterproofing around the flange when the waterproof device is used in water. As the structure for the waterproofing is not moved regardless of extension/retraction of the cylindrical portion of the extensible member, waterproof performance does not become unstable.

In the waterproof device in a preferable mode of the present invention, the extensible member may be made of a soft material in an integral manner, and the seating portion and the presser portion may sandwich the flange to thereby waterproof around the flange.

When the waterproof device in the preferable mode is used in water, as a route of water entry into device outer housing from the holding member and the inside of the extensible member, it is possible to consider the route of passing between the flange of the extensible member and the presser portion of the holding member, then, passing between the flange and the seating portion of the device outer housing, further passing through the hole of the device outer housing.

However, as the soft flange included in the extensible member is sandwiched between the seating portion of the device outer housing and the presser portion of the holding member contacting the flange, the diameter of the water entry route is blocked and the waterproofing around the flange is secured, therefore, it is possible to prevent water from entering the inside of the device outer housing. As the structure for the waterproofing is not moved in both cases where the cylindrical portion of the extensible member extends and retracts to the original state, the waterproof performance does not become unstable. Moreover, the flange doubles as the sealing ring as the flange is soft, which can reduce the number of parts for the waterproofing.

In the waterproof device in a preferable mode of the present invention, the operation shaft may be connected to the closed end of the cylindrical portion.

In the preferable mode, as the extensible member and the operation shaft can be assembled, the number of parts on the assembly can be reduced. Accordingly, it is possible to hold the operation shaft so as not to fall off from the extensible member.

In the waterproof device in a preferable mode of the present invention, the holding member may include a stopper portion narrowing down a hole diameter of the through hole, the operation shaft may include an engaging portion engaged so as to contact the stopper portion from the inner side of the device outer housing when the operation shaft is in an unpushed state, and the cylindrical portion can be elastically deformed and is elastically deformed in a state of allowing further elastic deformation when the operation shaft is in the unpushed state.

In the preferable mode, as the cylindrical portion of the extensible member stretched with the push-in of the operation shaft pushes back the operation shaft as the cylindrical portion returns to the original state due to elasticity thereof. In this case, the operation shaft contacts the stopper portion of the holding member at a point when the operation shaft is returned to the original state, therefore, the operation shaft is not further moved and does not fall off from the device outer housing. Additionally, as the cylindrical portion is elastically deformed even when the operation shaft is positioned by the stopper portion, the operation shaft is in a state of being sandwiched between the closed end of the cylindrical portion and the stopper portion. Therefore, it is possible to prevent the operation shaft from being moved improperly in the axial direction thereof when the waterproof device is carried about.

In order to solve the above problems, a portable timepiece according to an embodiment of the present invention is formed by a waterproof device according to any one of the above respective inventions.

According to the present invention, the portable timepiece is formed by the waterproof device according to any one of the respective inventions, therefore, it is possible to provide a portable timepiece capable of improving waterproof property in the push-in operation portion formed by including the extensible member, the holding member and the operation shaft.

According to the present invention, the structure for the waterproofing including the flange of the extensible member, the seating portion of the device outer housing and the pressure portion of the holding member which sandwich the flange is not moved regardless of the movement of the operation shaft, therefore, the waterproof device and the portable timepiece capable of improving waterproof property in the push-in operation portion can be provided.

DETAILED DESCRIPTION OF THE PREFERRED EMBODIMENTS

A first embodiment of the present invention will be explained with reference to FIG. 1 to FIG. 4.

Figure 1:
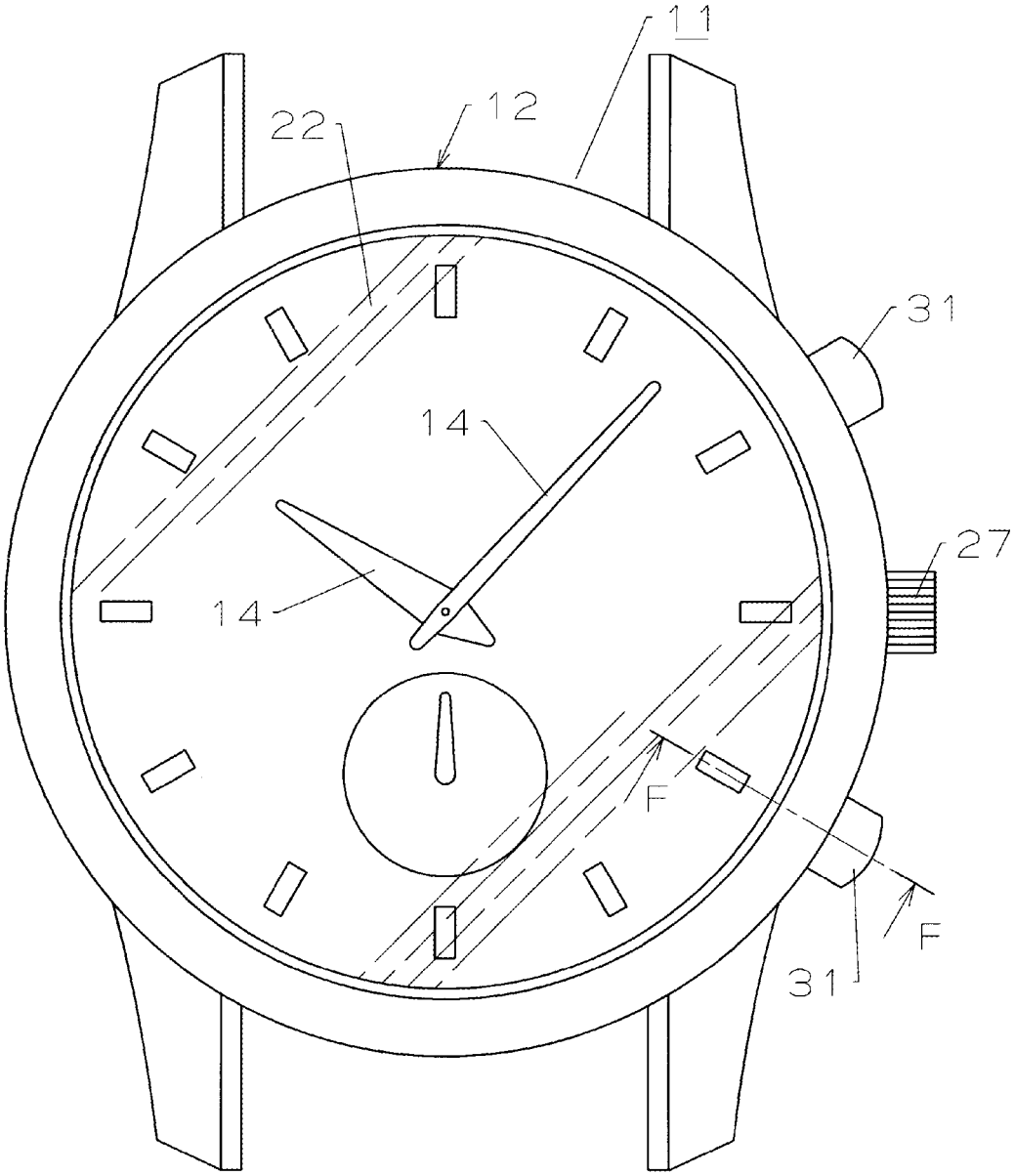
FIG. 1 is a front view showing a wrist watch according to a first embodiment of the present invention.
Figure 2:
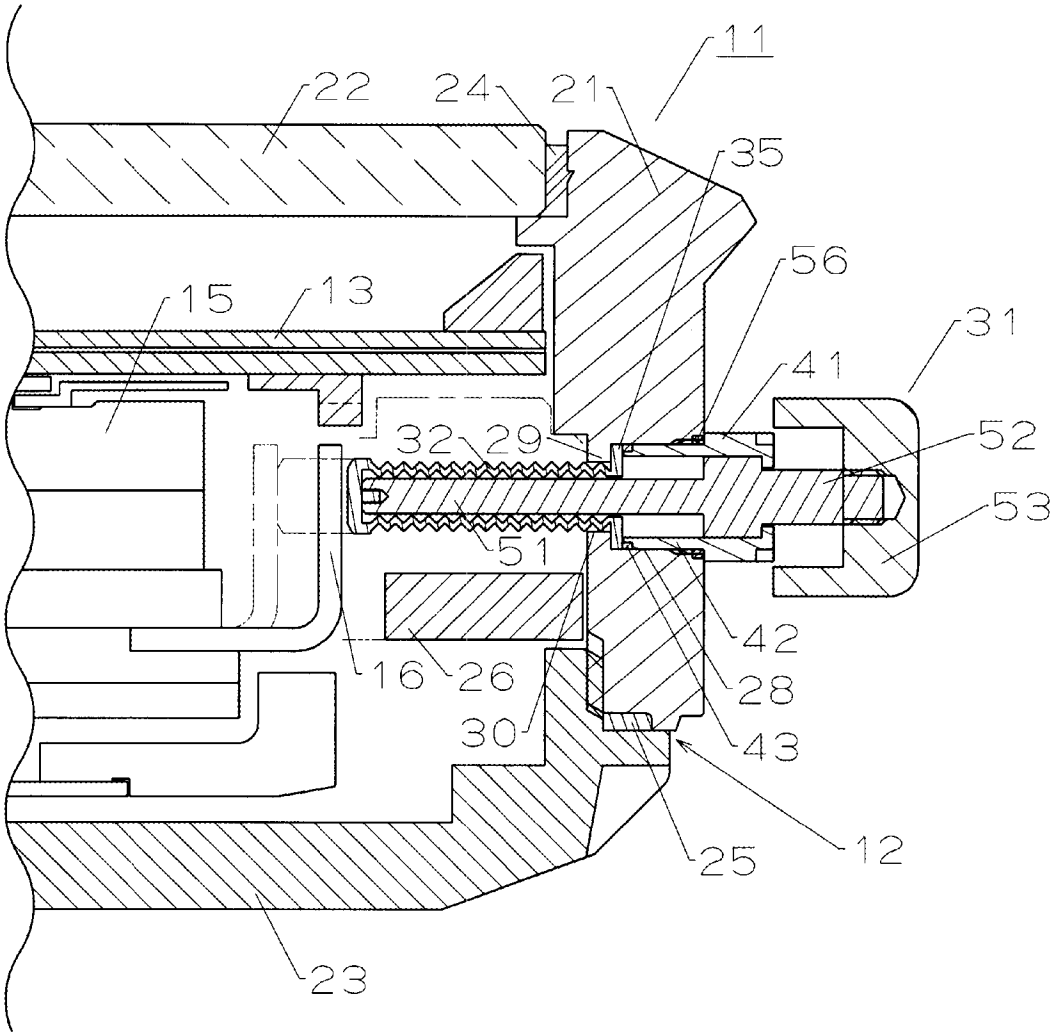
FIG. 2 is a cross-sectional view of the wrist watch shown along F-F line of FIG. 1.

A numeral 11 in FIG. 1 and FIG. 2 denotes a portable device, for example, a portable timepiece, which is specifically, a waterproof-type wrist watch having waterproof performance capable of being used in water. The wrist watch 11 includes a device outer housing, for example, an outer case 12 for the timepiece.

As shown in FIG. 2, a display window such as a dial window 13, an internal device such as a movement 15 controlling the movement of hour hands 14 (refer to FIG. 1) displaying time, a not-shown lamp, a power supply such as a not-shown battery and so on are housed inside the outer case 12.

The movement 15 includes at least one reaction member, for example, one contact member 16. These contact members 16 are formed by leaf springs and so on and protrude from the outer periphery the movement 15. When the contact members 16 are pushed by operation of later-described push-in operation portions 31, the movement 15 and the like fulfill functions given to respective push-in operation portions 31. For example, the push-in operation portion 31 on the upper right in FIG. 1 has a function of start/stop for measuring time, and the push-in operation portion 31 on the lower right has a function of turning on/off the lamp.

As shown in FIG. 2, the outer case 12 is formed so that a cover glass 22 through which the dial window 13 can be seen is liquid-tightly attached to the front surface of a shell 21 formed in an annular shape and made of a metal such as stainless steel or titanium, a synthetic resin and so on, and a back cover 23 made of a metal, a synthetic resin or the like is liquid-tightly attached to the back surface of the shell 21. In the first embodiment, the shell 21 is formed by a single metal part, or, instead of the above, can be formed by plural shell members made of a metal integrated by brazing and so on.

Numerals 24 and 25 in FIG. 2 respectively denote packings for holding liquid tightness of the outer case 12. A numeral 26 in FIG. 2 denotes an inner frame supporting the movement 15, and further, a numeral 27 in FIG. 1 denotes a winder for operating the movement 15.

As shown in FIG. 2, the outer case 12 has a housing concave portion 28, a seating portion 29 and a hole 30 at a portion where the later-described push-in operation portion 31 is arranged.

Specifically, the housing concave portion 28 is formed in the shell 21 so as to open to the outside of the outer case 12. The seating portion 29 forms the bottom of the housing concave portion 28. The hole 30 pierces the center of the seating portion 29. Accordingly, the inside and the outside of the shell 21 are connected through the housing concave portion 28 and the hold 30 in a state where the shell 21 is a simple substance. A female screw portion 28*a* is formed on an inner peripheral wall surface sectioning the housing concave portion 28 so as to be close to an open end of the housing concave portion 28 with respect to the outside of the shell.

The push-in operation portions 31 are provided at given places of the outer case 12, for example, two places of the shell 21 forming a circumferential side wall of the outer case 12, and specifically, on both sides of the winder 27 sandwiching the winder 27 (the upper side and the lower side of the winder 27 in FIG. 1). As these push-in operation portions 31 have the same structure, the push-in operation portion 31 having a function of turning on/off the lamp illuminating the dial window 13 will be explained here as a representative.

Figure 3:
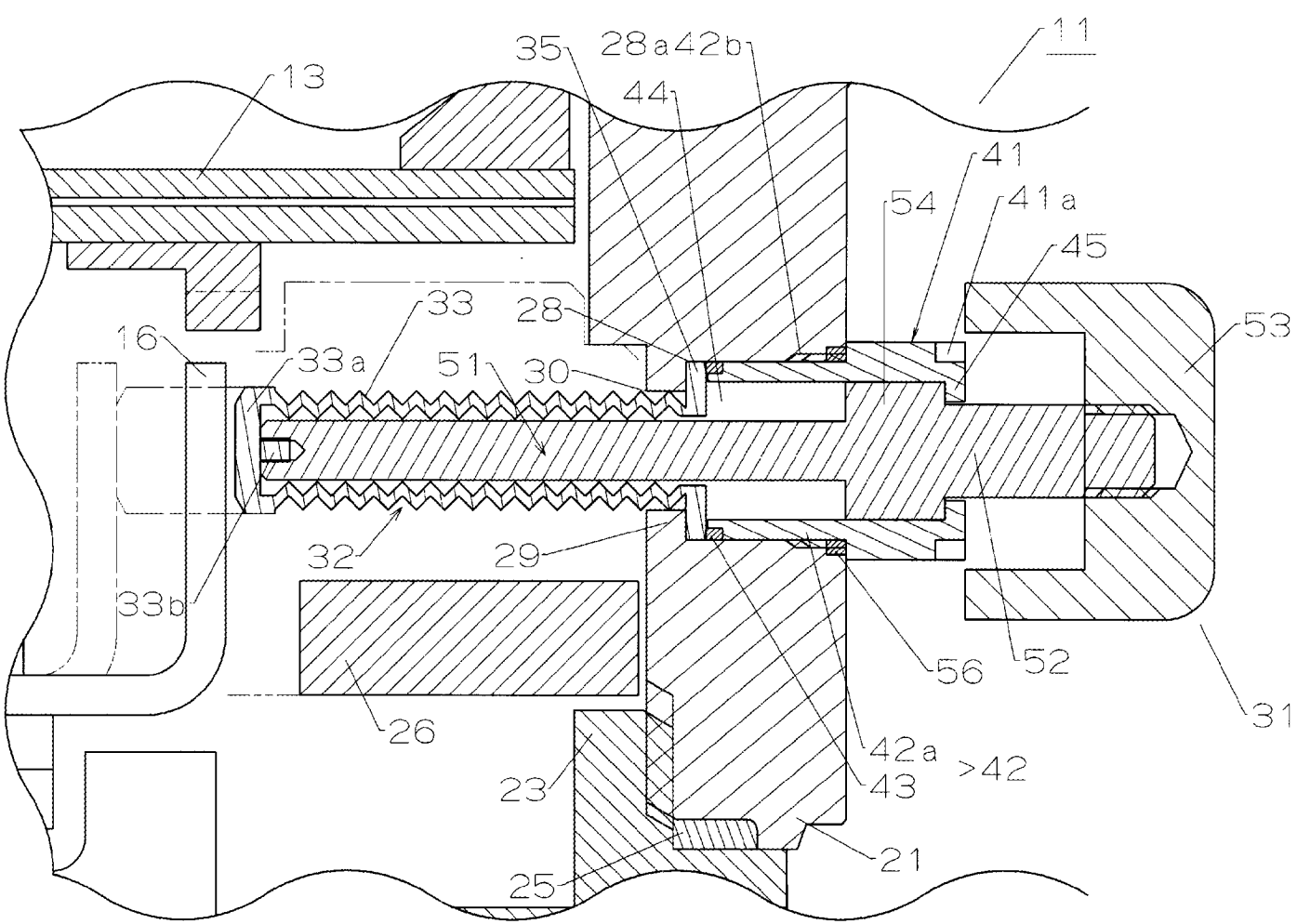
FIG. 3 is a cross-sectional view showing a push-in operation portion included in the wrist watch of FIG. 1 on an enlarged scale.
Figure 4:
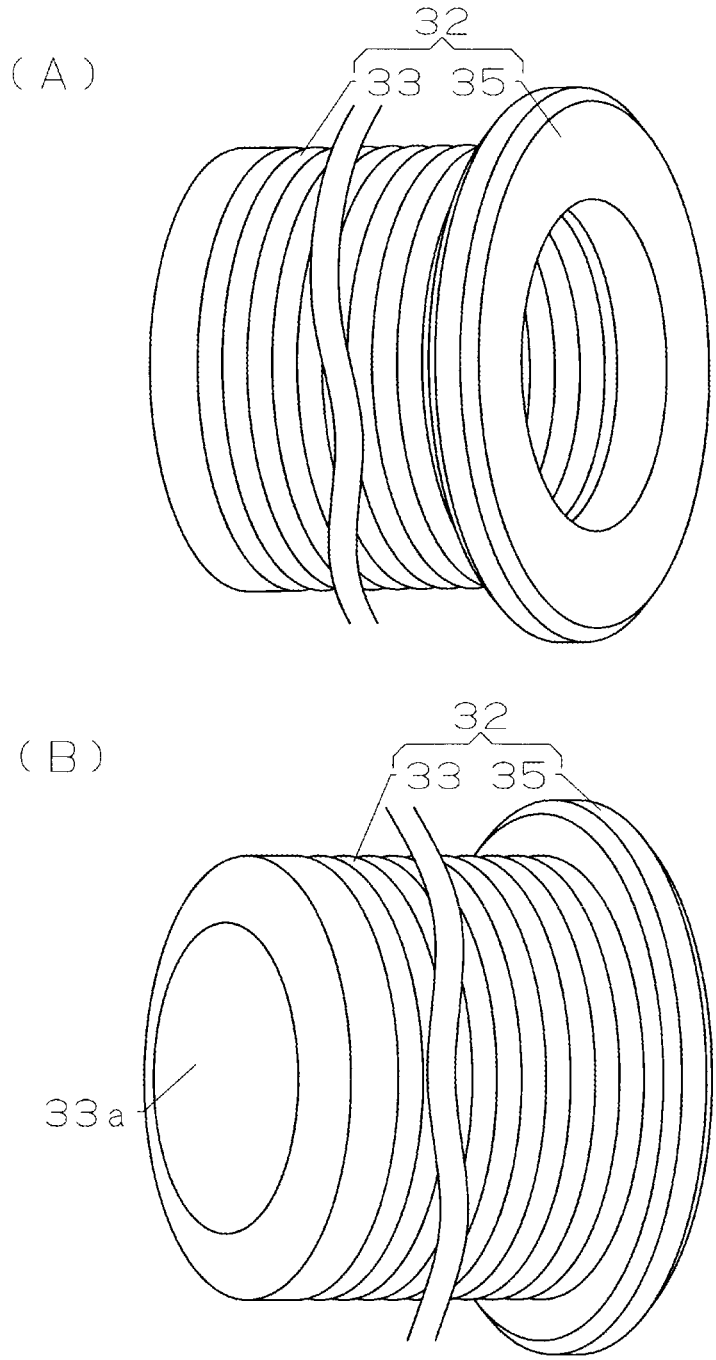
FIG. 4(A) is a perspective view showing an extensible member included in the push-in operation portion of the wrist watch of FIG. 1.
FIG. 4(B) is a perspective view showing the extensible member seen from a direction different from FIG. 4(A).

As shown in FIG. 2 and FIG. 3, the push-in operation portion 31 includes an extensible member 32, a holding member 41 and an operation shaft 51.

Specifically, as shown in FIG. 3, FIGS. 4(A) and (B), the extensible member 32 is formed by, for example, a metal integrated part, including a cylindrical portion 33 and a flange 35. The extensible member 32 in the first embodiment is formed by, for example, a bellows which can be extended and retracted. Accordingly, waterproof property from the inside of the extensible member 32 (inside of the cylindrical portion 33) to the outside is secured.

One end of the cylindrical portion 33 in the axial direction is closed by an end wall 33*a* and the other end in the axial direction is opened. Portions of the cylindrical portion 33 other than the end wall 33*a* have a bellows shape and a cross section thereof in a direction orthogonal to the axial direction is a circle. The cylindrical portion 33 can be extended and retracted in the axial direction with deformation due to portions other than the end wall 33*a*. It is preferable that the extensible member 32 made of a metal is used in a point that durability is high with respect to extension/retraction operation of the cylindrical portion 33. As shown in FIG. 3, the end wall 33*a* is formed orthogonal to the axial direction of the cylindrical portion 33 with a large thickness so as not to be easily deformed. The end wall 33*a* has a connecting portion 33*b*. The connecting portion 33*b* is formed, for example, by a screw portion protruding inside the cylindrical portion 33.

The flange 35 projecting integrally from the outer periphery of the other end portion of the cylindrical portion 33 in the axial direction to be formed in an annular shape continuously around the cylindrical portion 33 in the circumferential direction. The flange 35 is formed with a large thickness so as not to be easily deformed, and an outside diameter thereof is approximately equal to diameters of the housing concave portion 28 and the seating portion 29.

The extensible member 32 allows the cylindrical portion 33 to pierce through the hole 30 of the outer case 12 from the outside to the inside of the outer case 12 as well as allows the flange 35 housed in the housing concave portion 28 to be seated (contacted) on the seating portion 29 to thereby be combined with the outer case 12. Accordingly, the end wall 33*a* of the cylindrical portion 33 exists close to and faces the contact member 16 so as to push the contact member 16. Therefore, when the cylindrical portion 33 is extended, the contact member 16 is pushed.

The holding member 41 is made of the same material as the shell 21, including a presser portion 42, a through hole 44 and a stopper portion 45.

The presser portion 42 is a portion for sandwiching the flange 35 with the seating portion 29. The presser portion 42 is formed by, for example, including a circular cylindrical portion 42*a* fitted to the housing concave portion 28 and a sealing ring 43 for waterproofing in the first embodiment. Moreover, a male screw portion 42*b* to be screwed to the female screw portion 28*a* so as to be detachable is provided on the outer periphery of the circular cylindrical portion 42*a*. The made screw portion 42*b* and the female screw portion 28*a* form an attaching means of the holding member 41 with respect to the outer case 12.

The sealing ring 43 is attached so as to fit to the outer periphery of a tip portion of the circular cylindrical portion 42*a* with a small diameter. The sealing ring 43 protrudes from a tip end face of the circular cylindrical portion 42*a* in the above attachment state. The sealing ring 43 is made of materials which can be elastically deformed, for example, soft plastic such as soft polypropylene and soft vinyl chloride, soft resin such as elastomer or synthetic rubber such as fluorine rubber and silicone rubber. An outside diameter of the sealing ring 43 in a free state is larger than the diameter of the housing concave portion 28.

The through hole 44 pierces the center of the holding member 41 in a thickness direction thereof. Accordingly, the through hole 44 pierces the presser portion 42. The stopper portion 45 is provided so as to narrow down the hole diameter of the through hole 44.

The holding member 41 is attached to the shell 21 by inserting the presser portion 42 into the housing concave portion 28 as well as rotating the male screw portion 42*b* in a fastening direction in a state of being screwed to the female screw portion 28*a*. Note that it is possible to remove the holding member 41 from the outer case 12 by rotating the holding member in the opposite direction. A numeral 41*a* in FIG. 3 shows concave portions formed along the outer peripheral portion of the holding member 41 with a larger diameter than the pressure portion 42 along a circumferential direction at intervals, and the holding member 41 can be rotated by engaging a tool (not shown) with these concave portions.

The operation shaft 51 is made of a metal or a hard synthetic resin, which is provided so as to be inserted into the cylindrical portion 33 as well as pierce the through hole 44. Accordingly, a shaft end portion 52 of the operation shaft 51 protrudes to the outside of the holding member 41 through the through hole 44. An operation head 53 is connected to the shaft end portion 52. Though the shaft end portion 52 and the operation head 53 are screwed to each other, they can be connected to each other by other connecting means. The operation head 53 covers the holding member 41.

The operation head 53 can be omitted. However, when the operation head 53 is used, the contact area between the shaft head 53 and a fingertip of a user is increased as compared with the case where the user directly performs the push-in operation of the shaft end portion 52. Accordingly, this is preferable in a point of improving push-in operationality of the operation shaft 51 as well as in a point of expecting contribution with respect to the design (decoration) of the wrist watch 11.

The operation shaft 51 is connected to the connecting portion 33*b* of the end wall 33*a*. The connection is performed by screwing the connecting portion 33*b* into a screw hole formed at an end portion of the operation shaft 51 on the opposite side of the shaft end portion 52. However, it is also preferable, instead of the above, that the connection may be performed by fitting the outer peripheral portion of the connecting portion 33*b* to a connecting hole formed at the end portion of the operating shaft 51 on the opposite side of the shaft end portion 52 and by caulking them. The above case is preferable in a point that the labor of processing thread grooves on the outer periphery of the connecting portion 33*b* and the connecting hole can be omitted.

The operation shaft 51 includes an engaging portion 54. The engaging portion 54 is a portion having the maximum diameter in the operation shaft 51, and the diameter thereof is approximately the same as the maximum diameter of the through hole 44. The engaging portion 54 is engaged so as to contact the stopper portion 45 from the inner side of the outer case 12 when the operation shaft 51 is in an unpushed state as shown in FIG. 3. Diameters of portions other than the engaging portion 54 in the operation shaft 51 are smaller than a diameter of the hole 30 and the inside diameter of the cylindrical portion 33.

Next, a procedure of assembling the push-in operation portion 31 will be explained. First, the operation shaft 51 is inserted into the cylindrical portion 33 of the extensive member 32 through an open end thereof as well as a rotation operation of the operation shaft 51 is performed to thereby screw the operation shaft 51 to the connecting portion 33*b* of the cylindrical portion 33.

In the case where the extensible member 32 and the operation shaft 51 are supplied as an assembly assembled by the above procedure, the number of parts on assembling the push-in operation portion 31 can be reduced, which facilitates the assembly. Additionally, as the operation shaft 51 is held by the extensible member 32 to which the operation shaft 51 is connected, it is possible to prevent the operation shaft 51 from falling off improperly even when the push-in operation portion 31 having a structure in which the stopper portion 45 and the engaging portion 54 are omitted.

Next, the holding member 41 is attached to the outer case 12 from the outside thereof while allowing the portion of the operation shaft 51 protruding from the cylindrical portion 33 to pierce the through hole 44 of the holding member 41.

That is, the presser portion 42 of the holding member 41 is inserted into the housing concave portion 28 of the outer case 12. At this time, the outer peripheral surface of the sealing ring 43 of the presser portion 42 contacts the inner peripheral wall surface sectioning the housing concave portion 28, therefore, the diameter of the sealing ring 43 is reduced with elastic deformation, and insertion of the presser portion 42 into the housing concave portion 28 proceeds. Moreover, the holding member 41 is rotated so as to be screwed in the above insertion state, thereby screwing the female screw portion 28*a* of the outer case 12 with the male screw portion 42*b* of the holding member 41.

Accordingly, the holding member 41 is attached to the outer case 12. Additionally, the extensible member 32 is attached to the outer case 12 with the flange 35 sandwiched between the presser portion 42 and the seating portion 29. In this case, the flange 35 is sandwiched between the presser portion 42 and the seating portion 29 in a state where the seal ring 43 closely contacts the flange 35 with elastic deformation in the thickness direction.

In the first embodiment, an end face of the tip portion with the small diameter of the circular cylindrical portion 42*a* included in the presser portion 42 does not contact the flange 35, and a gap is formed between them. Regardless of the above, the portion between the end face of the tip portion with the small diameter and the flange 35 are liquid-tightly sealed by the sealing ring 43 of the presser portion 42. That is, the waterproofing around the flange 35 can be secured in the state of sandwiching the flange 35 between the sealing ring 43 and the seating portion 29. Additionally, the outer peripheral surface of the sealing ring 43 closely contacts the inner peripheral wall surface sectioning the housing concave portion 28 as described above, therefore, the portion between the outer peripheral surface of the sealing ring 43 and the inner peripheral wall surface can be liquid-tightly sealed by the sealing ring 43.

The state in which the push-in portion 31 is assembled by the above procedure is shown in FIG. 2 and FIG. 3. In the assembly-completed state, the through hole 44 of the holding member 41 faces the opening of the cylindrical portion 33 included in the extensible member 32 to thereby connect the through hole 44 to the cylindrical portion 33.

Moreover, the cylindrical portion 33 of the extensible member 32 is elastically deformed to some degree in the assembly-completed state. The operation shaft 51 is in a state of being slightly biased toward the outside of the outer case 12 with an elastic force in the above state. The elastic deformation at this time is in a state of allowing further elastic deformation, namely, elastic deformation in a direction in which the cylindrical portion 33 further extends when the operation shaft 51 is in the unpushed state (described later).

Then, the operation shaft 51 is biased by the elastic force of the cylindrical portion 33 as described above. Accordingly, the engaging portion 54 of the operation shaft 51 is in a state of being engaged with the stopper portion 45 of the holding member 41 as well as the shaft end portion 52 of the operation shaft 51 protrudes to the outside of the outer case 12 through the through hole 44. Therefore, the shaft end portion 52 is in a state of being able to be pushed toward the inside of the outer case 12. In other words, the operation shaft 51 is held in the unpushed state. The cylindrical portion 33 can be extended by pushing the operation shaft 51 in the unpushed state. At the last of the assembly, the operation head 53 is attached to the shaft end portion 52 in a screwed manner. The operation head 53 can be removed.

Moreover, in the unpushed state, the end wall 33*a* of the cylindrical portion 33 to which the operation shaft 51 is connected and the stopper portion 45 with which the engaging portion 54 is engaged restrain the operation shaft 51 so as not to move in the axial direction. Accordingly, it is possible to suppress occurrence of abnormal noise due to improper movement of the operation shaft 51 as well as to suppress progress of abrasion of the cylindrical portion 33 due to friction with respect to the operation shaft 51.

It is possible to apply a structure in which the operation shaft 51 is allowed to contact the end wall 33*a* without being connected to the end wall 33*a* in the unpushed state of the operation shaft 51, and the operation shaft 51 is restricted so as not to move in the axial direction by engaging the engaging portion 54 with the stopper portion 45. Also in the structure, the operation shaft 51 can be constructed so as not to move improperly.

Moreover, a numeral 56 in FIG. 3 denotes another sealing ring. Another sealing ring 56 is sandwiched between the shell 21 and the holding member 41 on the outer side of the outer case 12 seen from the screwed portion of the female screw portion 28*a* and the male screw portion 42*b* as well as the seal ring 43. Rustproof performance of the push-in operation portion 31 can be positively secured due to double sealing by the sealing ring 43 and another sealing ring 56.

Additionally, it is possible to prevent oxidation of the screwed portion due to water entry to the screwed portion and intrusion of foreign matter such as sand to the screwed portion by another sealing ring 56. Accordingly, even after the wrist watch 11 is used for a long term, it is possible to prevent the increase of a force for turning the holding member 41 in a relaxing direction for releasing the engagement of the screwed portion. Accordingly, it becomes easy to take apart the push-in operation portion 31. It is also possible to omit another sealing ring 56 to achieve the device.

When the operation shaft 51 is pushed by touching a finger of the user to the operation head 53 in the wrist watch 11 including the push-in operation portion 31 assembled as described above, the cylindrical portion 33 is stretched in conjunction with the push so as to protrude into the shell 21 with elastic deformation. As a result, the operation shaft 51 pushes the contact member 16 closely contacts and faces the end wall 33*a* through the end wall 33*a* of the cylindrical portion 33. Accordingly, a function assigned to the push-in operation portion 31 to which push-in operation is performed is realized, and for example, a lamp for illuminating the dial window 13 is turned on.

After that, when the force of push-in operation with respect to the operation shaft 51 is not added, the cylindrical portion 33 is deformed so as to shorten the length by elastic force of itself. Accordingly, the operation shaft 51 is pushed back toward the outside of the shell 21 to be returned to a state before the push-in operation portion 31 is pushed.

When the wrist watch 11 is used in water, as the through hole 44 of the holding member 41 into which the shaft end portion 52 of the operation shaft 51 is inserted is connected to the inside of the extensible member 32, the through hole 44 and the inside of the cylindrical portion 33 of the extensible member 32 are exposed to water. However, as the extensible member 32 is the integrated part, there is no danger that water enters into the outer case 12 through the extensible member 32 as long as the extensible member 32 is not damaged. Accordingly, as a route of water entry into the outer case 12, it is possible to consider a route of passing from the through hole 44 to a portion between the flange 35 of the extensible member 32 and the presser portion 42 of the holding member 41, then, passing between the flange 35 and the seating portion 29 of the outer case 12, further passing through the hole 30 of the outer case 12.

However, the flange 35 of the extensible member 32 made of the metal bellows is sandwiched between the seating portion 29 and the sealing ring 43 of the presser portion 42 in the thickness direction of the flange 35, and the sealing ring 43 closely contacts the flange 35 in the elastically deformed state. Accordingly, the water entry route is blocked between the flange 35 and the presser portion 42, and the waterproofing around the flange is secured, thereby preventing water entry into the outer case 12.

The structure for the waterproofing is formed so that the flange 35 of the extensible member 32 is sandwiched between the seating portion 29 of the outer case 12 in a fixed state with respect to extension/retraction of the extensible member 32 and the presser portion 42 of the holding member 41 attached to the outer case 12. Accordingly, the flange 35 is not moved in both cases where the cylindrical portion 33 of the extensible member 32 extends and retracts to the original state. Therefore, the waterproof performance of the push-in operation portion 31 does not become unstable.

As explained above, the waterproof property in the push-in operation portion 31 formed by including the extensible member 32, the holding member 41 and the operation shaft 51 can be improved.

Furthermore, the sealing ring 43 included in the presser portion 42 closely contacts the inner peripheral wall surface sectioning the housing concave portion 28 in the elastically deformed state. Accordingly, if water enters between the outer peripheral surface of the presser portion 42 and the inner peripheral wall surface sectioning the housing concave portion 28, the sealing ring 43 can block the water so as not to reach the inside of the shell 21. Therefore, it is possible to omit another sealing ring 56 and reduce the number of parts.

As explained above, even when the push-in operation is performed to the push-in operation portion 31 in water, it is possible to secure the waterproofing in the push-in operation portion 31 with high reliability. Accordingly, it is not necessary to form a locking means for inhibiting the push-in operation of the push-in operation portion 31 in water. Additionally, as the force of returning the operation shaft 51 to the unpushed state is given to the operation shaft 51 in the extensible member 32 which realizes the waterproofing, a part such as a coil spring for returning the shaft is not necessary. Accordingly, the push-in operation portion 31 has a simple structure and is formed to be compact, therefore, even when the outer case 12 is thin, the push-in operation portion 31 can be arranged while securing the waterproof property so as to correspond to the structure.

Additionally, the holding member 41 of the push-in operation portion 31 can be removed from the outer case 12 in a procedure reverse to the attachment, therefore, after that, the push-in operation portion 31 can be taken apart by pulling the operation shaft 51 and the extensible member 32 out of the outer case 12 by using the shaft end portion 52 of the operation shaft 51 as a handhold. Accordingly, if the waterproof property of the extensible member 32 is reduced, the replacement can be performed.

Figure 5:
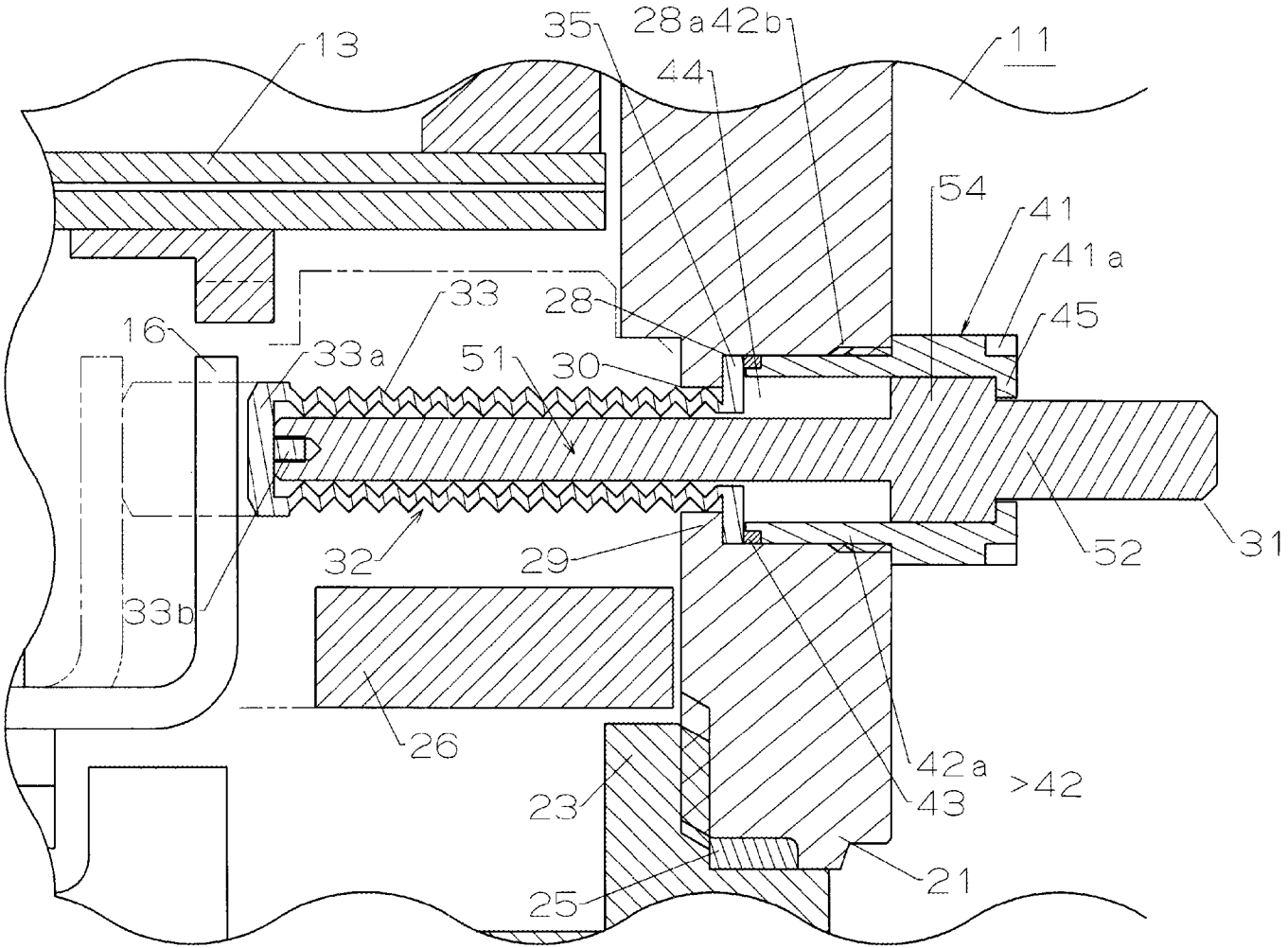
FIG. 5 is a cross-sectional view corresponding to FIG. 3 showing a push-in operation portion of a wrist watch according to a second embodiment of the present invention.

FIG. 5 shows a second embodiment of the present invention. Structures of the second embodiment are the same as the first embodiment except the following description, therefore, the same structures or structures having the same functions as the first embodiment will be denoted by the same numerals and the explanation will be omitted.

In the wrist watch 11 according to the second embodiment, the operation head explained in the first embodiment is omitted and the operation shaft 51 with a single shaft is formed, thereby simplifying the structure of the operation shaft 51. Additionally, another sealing ring explained in the first embodiment is also omitted. Other structures of the second embodiment are the same as the wrist watch 11 of the first embodiment including structures not shown in FIG. 5.

Accordingly, also in the second embodiment, it is possible to provide the wrist watch 11 capable of improving waterproof property in the push-in operation portion 31 formed by including the extensible member 32, the holding member 41 and the operation shaft 51 according to the reasons explained in the first embodiment.

Figure 6:
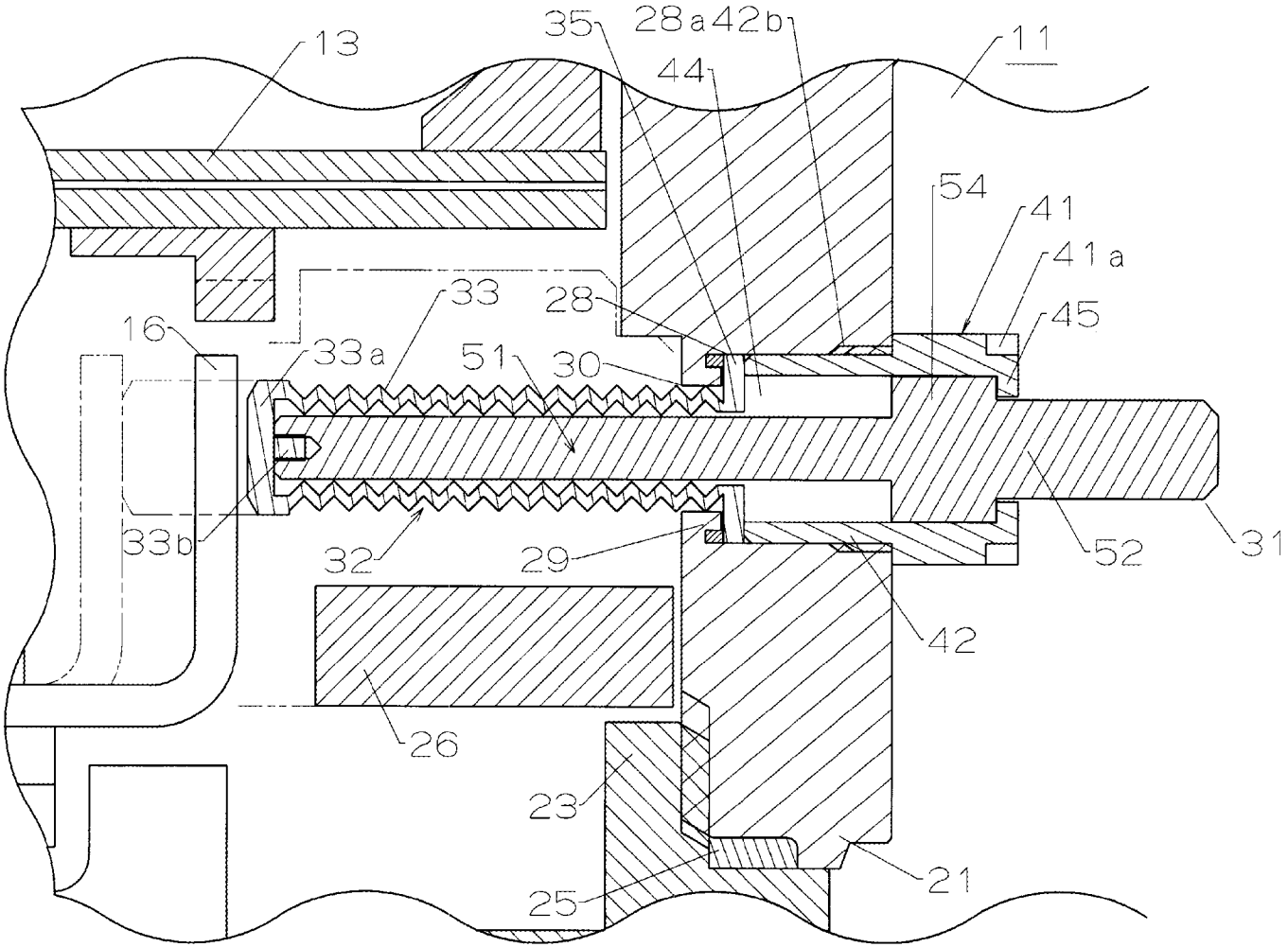
FIG. 6 is a cross-sectional view corresponding to FIG. 3 showing a push-in operation portion of a wrist watch according to a third embodiment of the present invention.

FIG. 6 shows a third embodiment of the present invention. Structures of the third embodiment are the same as the first embodiment except the following description, therefore, the same structures or structures having the same functions as the first embodiment will be denoted by the same numerals and the explanation will be omitted.

In the wrist watch 11 according to the third embodiment, the operation head explained in the first embodiment is omitted and the operation shaft 51 with a single shaft is formed, thereby simplifying the structure of the operation shaft 51. Additionally, another sealing ring explained in the first embodiment is also omitted.

Moreover, in the wrist watch 11 according to the third embodiment, the presser portion 42 does not include the sealing ring 43 but the sealing ring 43 is fitted to a circular groove formed on the seating portion 29. In a state where the sealing ring 43 included in the seating portion 29 as described above is allowed to contact the flange 35 as well as an end face of the circular cylindrical portion 42*a* included in the presser portion 42 is allowed to contact the flange 35, the flange 35 is sandwiched between the seating portion 29 and the presser portion 42. The sandwiched sealing ring 43 is held in the elastically deformed state.

Accordingly, water passing from the through hole 44 to a portion between the presser portion 42 and the flange 35 and water passing through the screwed portion between the female screw portion 28*a* and the male screw portion 42*b* are stopped by the sealing ring 43. As the waterproofing around the flange can be secured, water entry into the shell 21 can be prevented. In the third embodiment, the presser portion 42 is formed only by the circular cylindrical portion. Other structures of the third embodiment are the same as the wrist watch 11 of the first embodiment including structures not shown in FIG. 6.

Accordingly, also in the third embodiment, it is possible to provide the wrist watch 11 capable of improving waterproof property in the push-in operation portion 31 formed by including the extensible member 32, the holding member 41 and the operation shaft 51 according to the reasons explained in the first embodiment.

Figure 7:
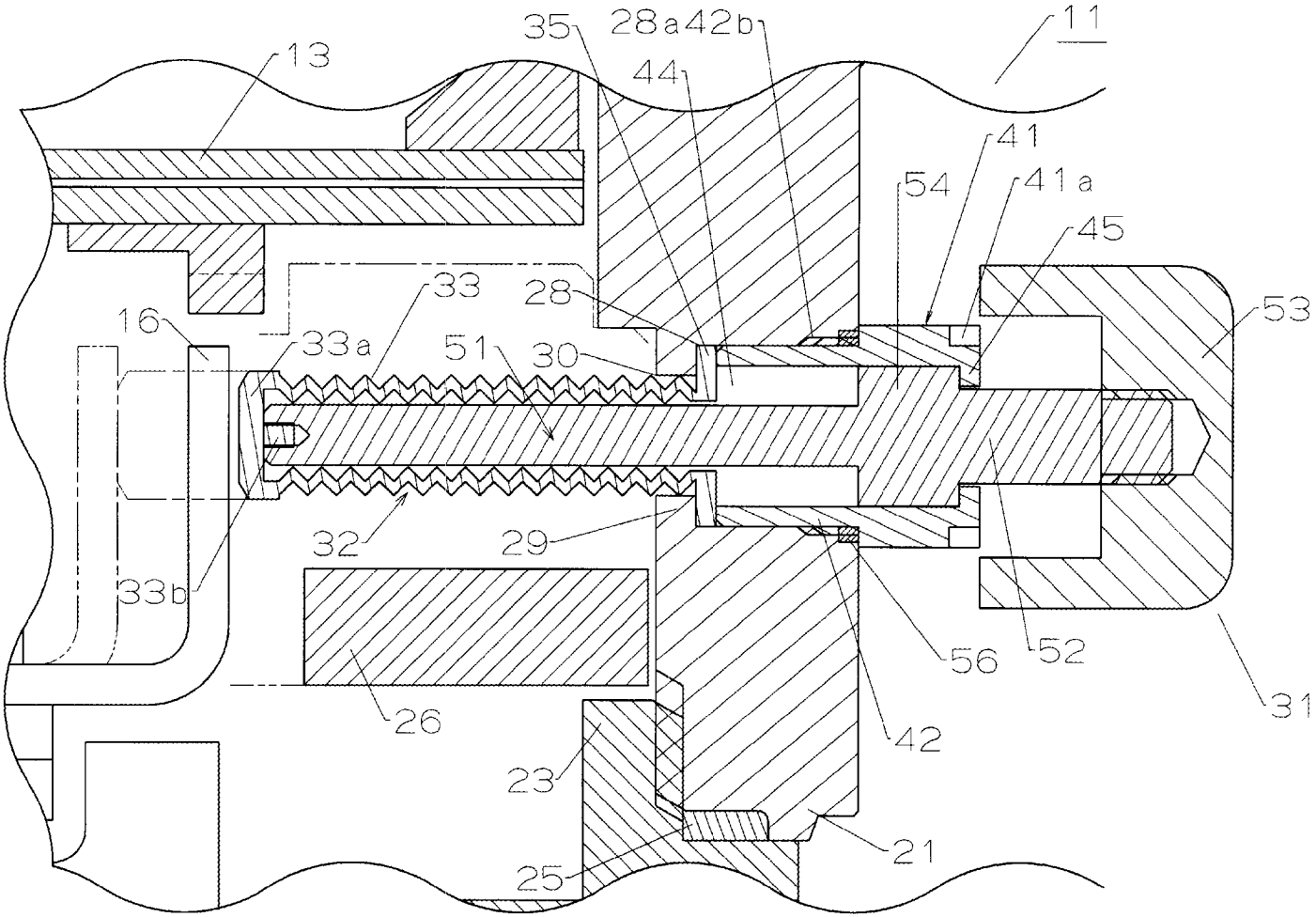
FIG. 7 is a cross-sectional view corresponding to FIG. 3 showing a push-in operation portion of a wrist watch according to a fourth embodiment of the present invention.

FIG. 7 shows a fourth embodiment of the present invention. Structures of the fourth embodiment are the same as the first embodiment except the following description, therefore, the same structures or structures having the same functions as the first embodiment will be denoted by the same numerals and the explanation will be omitted.

In the wrist watch 11 according to the fourth embodiment, the extensible member 32 is integrally formed by using a soft material, not using the metal bellows. As materials for making the extensible member 32, soft materials which can be elastically deformed, for example, soft plastic such as soft polypropylene and soft vinyl chloride, soft resin such as elastomer or synthetic rubber such as fluorine rubber and silicone rubber can be cited. Accordingly, the flange 35 of the extensible member 32 can be elastically deformed in the thickness direction. As the extensible member 32 made of a soft material is preferable in a point that corrosion resistance with respect to sea water and so on is higher than the extensible member made of a metal, it is suitable as a part of a divers watch which may be used in sea water.

Additionally, in a form in which the tip of the presser portion 42 included in the holding member 41 touches the flange 35, the presser portion 42 and the seating portion 29 of the outer case 12 sandwich the flange 35 in the elastically deformed state. Accordingly, water passing from the through hole 44 to a portion between the presser portion 42 and the flange 35 can be stopped as well as water passing between the seating portion 29 and the flange 35 toward the hole 30 can be stopped. As the waterproofing around the flange can be secured as described above, it is possible to prevent water from entering into the shell 21. In the fourth embodiment, the presser portion 42 is formed only by the circular cylindrical portion. Other structures of the fourth embodiment are the same as the wrist watch 11 of the first embodiment including structures not shown in FIG. 7.

Accordingly, also in the fourth embodiment, it is possible to provide the wrist watch 11 capable of improving waterproof property in the push-in operation portion 31 formed by including the extensible member 32, the holding member 41 and the operation shaft 51 according to the reasons explained in the first embodiment. Moreover, as the flange 35 doubles as a seal packing, the number of parts forming the push-in operation portion 31 can be reduced and the structure can be simplified.

In the above embodiment, the flange 35 has an annular shape, however, the present invention is not limited to the above, and for example, the shape of the flange may be a polygonal shape. In other words, the flange 35 can apply various shapes as long as the flange can be seated on the seating portion 29.

What is claimed is:

1. A waterproof device comprising:

a device outer housing including a seating portion and a hole piercing the center of the seating portion;

an extensible member with waterproof property, including a cylindrical portion which can be extended/retracted in an axial direction, closing one end in the axial direction as well as opening the other end in the axial direction, and inserted into the hole, and a flange projecting integrally from an outer periphery of the other end portion of the cylindrical portion and seated on the seating portion from the outside of the device outer housing;

a holding member attached to the device outer housing, and including a presser portion sandwiching the flange with the seating portion in a thickness direction of the flange to thereby secure the waterproofing around the flange, and a through hole connecting to the opening; and an operation shaft including a shaft end portion protruding to the outside of the holding member through the through hole, which is inserted into the cylindrical portion and arranged in a state of being able to be pushed from the outside of the device outer housing so as to allow the cylindrical portion to extend.

2. The waterproof device according to claim 1, wherein the holding member can be removed from the device outer housing.

3. The waterproof device according to claim 1, wherein the extensible member is made of a metal bellows which is integrally formed, the presser portion has a sealing ring which can be elastically deformed, and the sealing ring and the seating portion sandwich the flange to thereby waterproof around the flange.

4. The waterproof device according to claim 2, wherein the extensible member is made of a metal bellows which is integrally formed, the presser portion has a sealing ring which can be elastically deformed, and the sealing ring and the seating portion sandwich the flange to thereby waterproof around the flange.

5. The waterproof device according to claim 3, wherein the device outer housing has a housing concave portion into which the presser portion is inserted and including the seating portion as the bottom, and an outer periphery of the sealing ring closely contacts an inner peripheral wall surface sectioning the housing concave portion.

6. The waterproof device according to claim 4, wherein the device outer housing has a housing concave portion into which the presser portion is inserted and including the seating portion as the bottom, and an outer periphery of the sealing ring closely contacts an inner peripheral wall surface sectioning the housing concave portion.

7. The waterproof device according to claim 1, wherein the extensible member is made of a metal bellows which is integrally formed, the seating portion has a sealing ring which can be elastically deformed, and the sealing ring and the presser portion sandwich the flange to thereby waterproof around the flange.

8. The waterproof device according to claim 2, wherein the extensible member is made of a metal bellows which is integrally formed, the seating portion has a sealing ring which can be elastically deformed, and the sealing ring and the presser portion sandwich the flange to thereby waterproof around the flange.

9. The waterproof device according to claim 1, wherein the extensible member is made of a soft material in an integral manner, and the seating portion and the presser portion sandwich the flange to thereby waterproof around the flange.

10. The waterproof device according to claim 2, wherein the extensible member is made of a soft material in an integral manner, and the seating portion and the presser portion sandwich the flange to thereby waterproof around the flange.

11. The waterproof device according to claim 1, wherein the operation shaft is connected to the closed end of the cylindrical portion.

12. The waterproof device according to claim 11, wherein the holding member includes a stopper portion narrowing down a hole diameter of the through hole, the operation shaft includes an engaging portion engaged so as to contact the stopper portion from the inner side of the device outer housing when the operation shaft is in an unpushed state, and the cylindrical portion can be elastically deformed and is elastically deformed in a state of allowing further elastic deformation when the operation shaft is in the unpushed state.

13. A portable timepiece formed by a waterproof device according to claim 1.

14. A portable timepiece formed by a waterproof device according to claim 11.

15. A portable timepiece formed by a waterproof device according to claim 12.

* * * * *